US011613948B2

(12) United States Patent
Samuelson et al.

(10) Patent No.: US 11,613,948 B2
(45) Date of Patent: Mar. 28, 2023

(54) ESCAPEMENT SYSTEM FOR SHIFTING A MEMBER IN A DOWNHOLE TOOL

(71) Applicants: Marc Samuelson, Houston, TX (US); Donavan Holland Brown, Houston, TX (US); Hai Hoang Nguyen, Houston, TX (US)

(72) Inventors: Marc Samuelson, Houston, TX (US); Donavan Holland Brown, Houston, TX (US); Hai Hoang Nguyen, Houston, TX (US)

(73) Assignee: BAKER HUGHES OILFIELD OPERATIONS LLC, Houston, TX (US)

( * ) Notice: Subject to any disclaimer, the term of this patent is extended or adjusted under 35 U.S.C. 154(b) by 38 days.

(21) Appl. No.: 17/488,414

(22) Filed: Sep. 29, 2021

(65) Prior Publication Data

US 2022/0154542 A1 May 19, 2022

Related U.S. Application Data

(60) Provisional application No. 63/114,033, filed on Nov. 16, 2020.

(51) Int. Cl.
*E21B 23/04* (2006.01)

(52) U.S. Cl.
CPC ..... *E21B 23/0422* (2020.05)

(58) Field of Classification Search
CPC .... E21B 23/0422; E21B 23/04; E21B 34/102; E21B 2200/06; E21B 33/00
See application file for complete search history.

(56) References Cited

U.S. PATENT DOCUMENTS

| | | | | |
|---|---|---|---|---|
| 3,163,222 | A * | 12/1964 | Foster | E21B 33/0355 166/344 |
| 4,363,358 | A * | 12/1982 | Ellis | E21B 23/04 166/212 |
| 10,408,017 | B2 * | 9/2019 | Kumar | E21B 23/00 |
| 10,648,287 | B2 * | 5/2020 | Styler | E21B 34/142 |
| 11,261,716 | B2 * | 3/2022 | Antonsen | E21B 34/14 |
| 2003/0183392 | A1 | 10/2003 | Garay | |

(Continued)

OTHER PUBLICATIONS

International Search Report and Written Opinion for International Application No. PCT/US2021/059083; Interntational Filing Date Nov. 12, 2021; Report dated Feb. 24, 2022 (pp. 1-9).

*Primary Examiner* — Shane Bomar
(74) *Attorney, Agent, or Firm* — Cantor Colburn LLP

(57) ABSTRACT

A downhole tool includes a tubular having an outer surface, an inner surface, a recess extending from the inner surface toward the outer surface, and an opening extending from the outer surface to the recess. A hydraulic passage extends through the tubular. The hydraulic passage includes an inlet, a first and a second branch. The second branch is fluidically exposed at the inner surface. A piston is arranged in the recess. A locking ring is arranged radially inwardly of the piston and a member is arranged in the tubular spaced from the inner surface. Application of hydraulic pressure in the first branch urges the piston radially inwardly clamping the locking ring against the member and application of hydraulic pressure in the second branch urges the member axially in a first direction relative to the tubular.

20 Claims, 6 Drawing Sheets

(56) References Cited

U.S. PATENT DOCUMENTS

| | | | | |
|---|---|---|---|---|
| 2013/0161017 | A1 | 6/2013 | King | |
| 2014/0048271 | A1* | 2/2014 | Coon | E21B 34/063 166/308.1 |
| 2015/0034330 | A1 | 2/2015 | Merron et al. | |
| 2015/0240598 | A1* | 8/2015 | Zhou | E21B 43/14 166/305.1 |
| 2016/0281466 | A1 | 9/2016 | Richards | |
| 2018/0038201 | A1* | 2/2018 | Evans | E21B 10/322 |
| 2018/0142530 | A1 | 5/2018 | Bane | |

* cited by examiner

ESCAPEMENT SYSTEM FOR SHIFTING A MEMBER IN A DOWNHOLE TOOL

CROSS-REFERENCE TO RELATED APPLICATIONS

This application claims the benefit of U.S. Provisional Patent Application No. 63/114,033, filed Nov. 16, 2020, the contents of which are incorporated by reference herein in their entirety.

BACKGROUND

In the resource recovery industry, it is often desirable to shift a member within a tubular. The member could shift axially, radially, or rotatably in order to perform a desired function. For example, many inflow control devices employ a sleeve that may be shifted in order to selectively expose an opening. In some cases, the sleeve is shifted axially, or along a longitudinal axis of the tubular. Typically, the sleeve is shifted in a first direction by hydraulic pressure applied at a first end and shifted in a second direction by hydraulic pressure applied at a second, opposing end. Other sliding, or shifting members are likewise generally controlled by the application of hydraulic pressure at opposing ends.

Existing systems allow a member to shift between two extremes. For example, the sleeve may shift between a first position covering an opening and a second position, uncovering the opening. However, in some instances, it is desirable to shift the member in increments. Current systems for shifting a member in increments rely on a series of, for example, J-slots of varying length. Manufacturing such systems requires machining internal and external surfaces of a tubular and typically necessitates that use of multiple sleeves that may detract from an overall flow area for treatment and/or production fluids. Accordingly, the industry would welcome a system for incrementally shifting a member in a tubular that is easier to manufacture and leaves an increased flow area in a tubular.

SUMMARY

Disclosed is a downhole tool including a tubular having an outer surface, an inner surface, a recess extending from the inner surface toward the outer surface, and an opening extending from the outer surface to the recess. A hydraulic passage extends through the tubular. The hydraulic passage includes an inlet, a first branch that extends from the inlet to the recess in a first direction and a second branch that extends from the inlet in a second, opposing direction. The second branch is fluidically exposed at the inner surface. A piston is arranged in the recess. The piston is shiftable relative to a radius of the tubular. A locking ring is arranged radially inwardly of the piston and a member is arranged in the tubular spaced from the inner surface. Application of hydraulic pressure in the first branch urges the piston radially inwardly clamping the locking ring against the member and application of hydraulic pressure in the second branch urges the member axially in a first direction relative to the tubular.

Also disclosed is a resource exploration and recovery system including a surface system, and a sub-surface system including a tubular string extending from the surface system. The tubular string supports a downhole tool having an outer surface, an inner surface, a recess extending from the inner surface toward the outer surface, and an opening extending from the outer surface to the recess. A hydraulic passage extends through the tubular. The hydraulic passage includes an inlet, a first branch that extends from the inlet to the recess in a first direction and a second branch that extends from the inlet in a second, opposing direction. The second branch is fluidically exposed at the inner surface. A piston is arranged in the recess. The piston is shiftable relative to a radius of the tubular. A locking ring is arranged radially inwardly of the piston and a member is arranged in the tubular spaced from the inner surface. Application of hydraulic pressure in the first branch urges the piston radially inwardly clamping the locking ring against the member and application of hydraulic pressure in the second branch urges the member axially in a first direction relative to the tubular.

Further disclosed is a method of shifting a member in a downhole tool including introducing fluid at a first pressure into an opening in a tubular, directing the fluid at the first pressure in a first direction to shift a member axially relative to the tubular, and directing the fluid at the first pressure in a second direction opposite the first direction, urging a piston radially inwardly onto the member.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
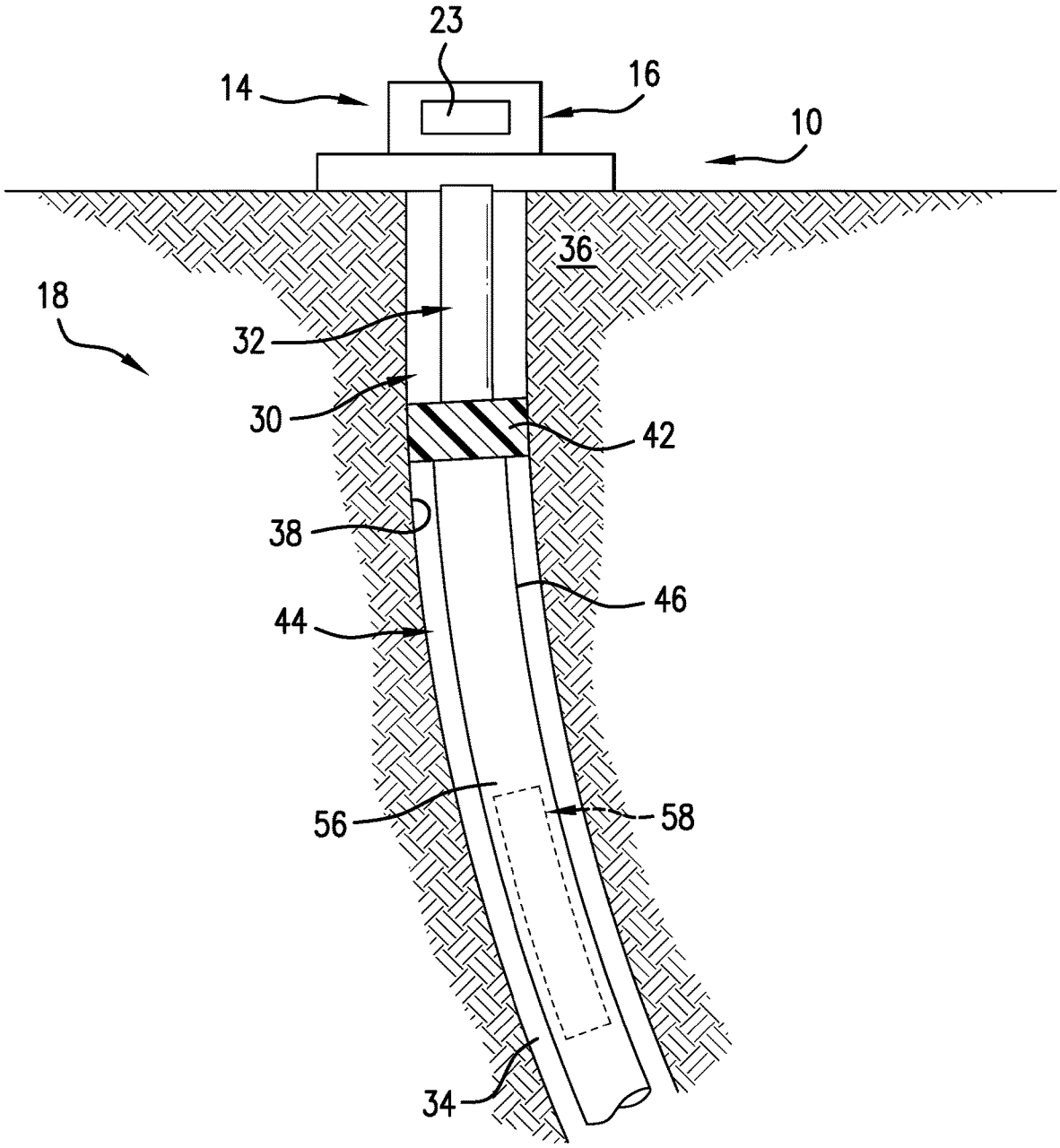
FIG. 1 depicts a resource exploration and recovery system including an escapement system for shifting a member in a downhole tool.

A resource exploration and recovery system, in accordance with an exemplary embodiment, is indicated generally at 10 in FIG. 1. Resource exploration and recovery system 10 should be understood to include well drilling operations, resource extraction and recovery, $CO_2$ sequestration, and the like. Resource exploration and recovery system 10 may include a first system 14 which, in some environments, may take the form of a surface system 16 operatively and fluidically connected to a second system 18 which, in some environments, may take the form of a subterranean system. First system 14 may include a control system 23 that may provide power to, monitor, communicate with, monitor downhole parameters, and/or activate one or more downhole operations/tools as will be discussed herein. Surface system 16 may include additional systems such as pumps, fluid storage systems, cranes and the like (not shown).

Second system 18 may include a work string 30, formed from one or more tubular members, such as indicated at 32, which extends into a wellbore 34 formed in a formation 36. Work string 30 may be part of a thru tubular system (not separately labeled) that may transport production fluids to surface system 16 and/or deliver treatment fluids into wellbore 34. Wellbore 34 includes an annular wall 38 which may be defined by a surface (not separately labeled) of formation 36. At least one packer, such as indicated at 42 is provided in wellbore 34. A production zone 44 is defined downhole of packer 42. The number, length and spacing of production zones may vary. A tubular 46 extends from packer 42 downhole. Tubular 46 may include openings (not shown) that are receptive of production fluids passing from formation 36 into wellbore 34 and/or allow fluids to pass from tubular 46 into formation 36.

Figure 2:
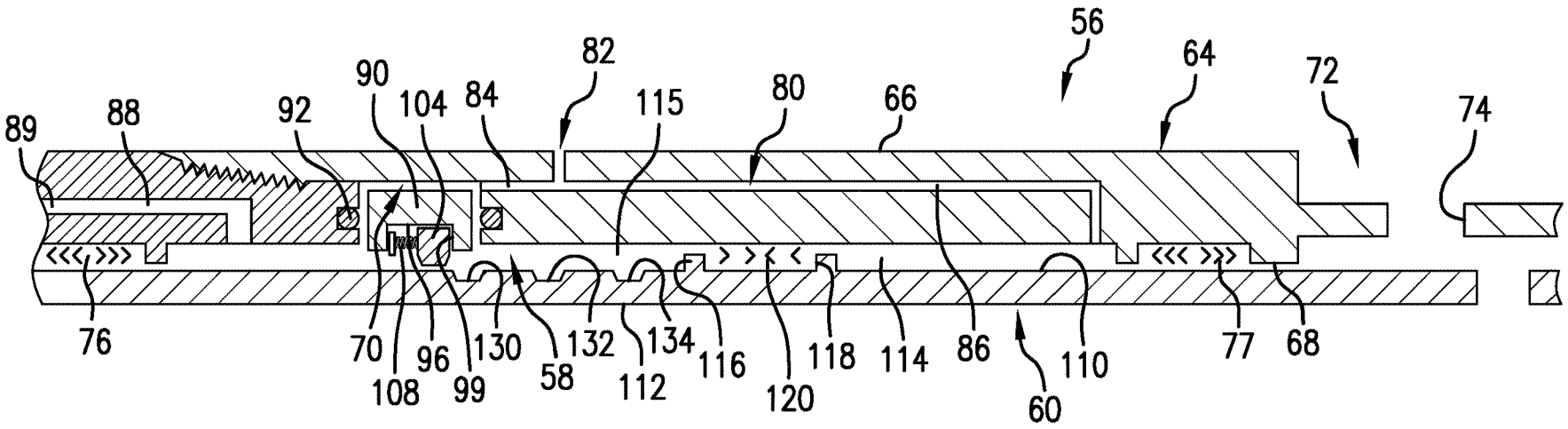
FIG. 2 depicts a partial cross-sectional view of the downhole tool showing an escapement system, in accordance with an exemplary embodiment.

In an embodiment, tubular 46 supports a downhole tool 56 having an escapement system 58 for shifting a member 60 (FIG. 2) as will be detailed herein. Downhole tool 56 includes a tubular 64 that defines a housing (not separately labeled) for escapement system 58. Tubular 64 includes an outer surface 66 and an inner surface 68 having a recess 70. An opening 72 extends through outer surface 66 and inner surface 68. Opening 72 may take the form of a production and/or treatment port 74. Inner surface 68 also supports a first annular seal 76 and a second annular seal 77. First and second annular seals 76 and 77 may take the form of chevron seals (not separately labeled).

A hydraulic passage 80 is defined in tubular 64. In an embodiment, hydraulic passage 80 extends between outer surface 66 and inner surface 68 and includes an inlet 82. Hydraulic passage 80 includes a first branch 84 that extends from inlet 82 in a first direction to recess 70 and a second branch 86 that extends from inlet 82 in a second direction between outer surface 66 and inner surface 68. Another hydraulic passage 88 including another inlet 89 is arranged in tubular 64 spaced from inlet 82. Another hydraulic passage 88 extends between outer surface 66 and inner surface 68.

Figure 3:
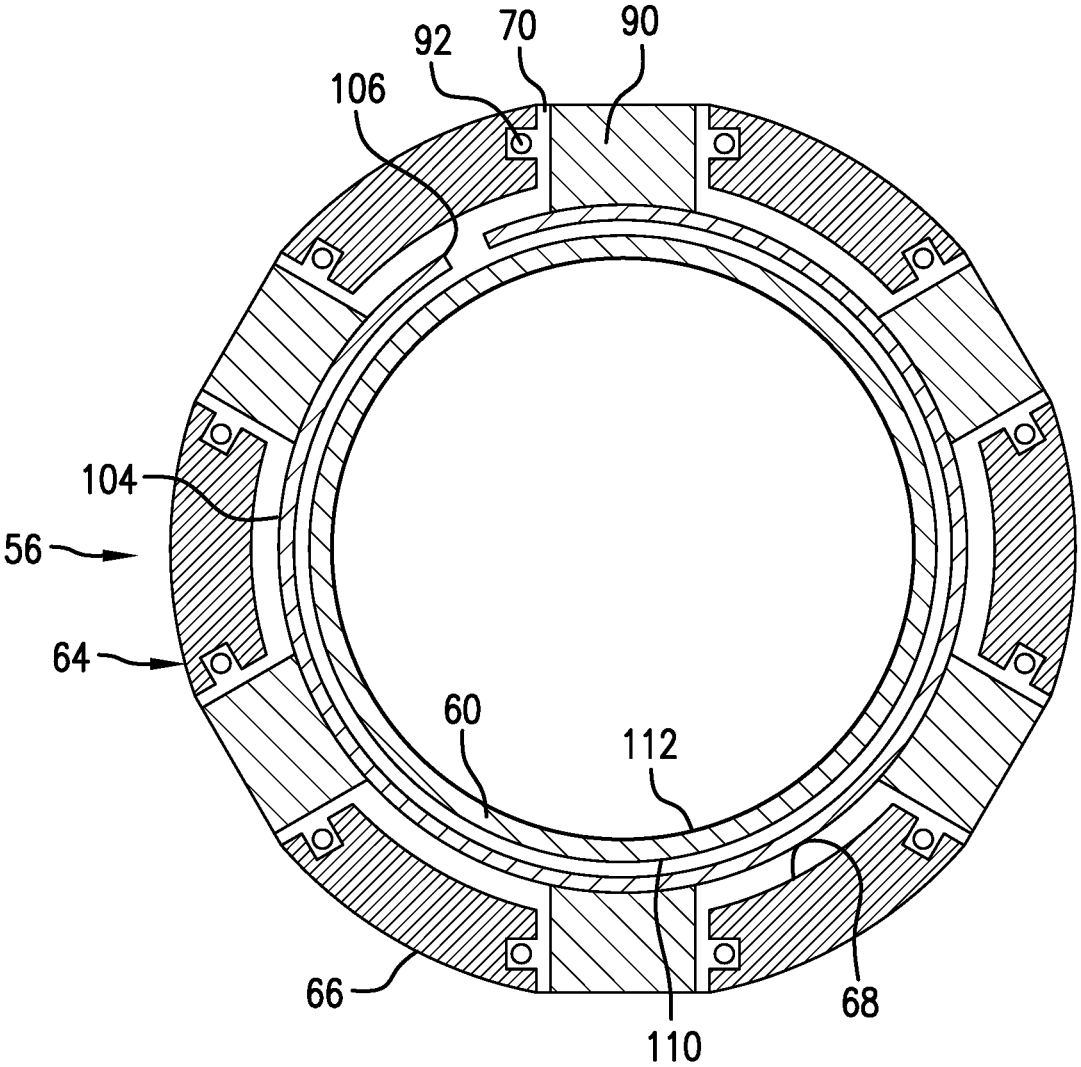
FIG. 3 depicts a cross-sectional axial end view of the downhole tool of FIG. 1, in accordance with an aspect of an exemplary embodiment.
Figure 4A:
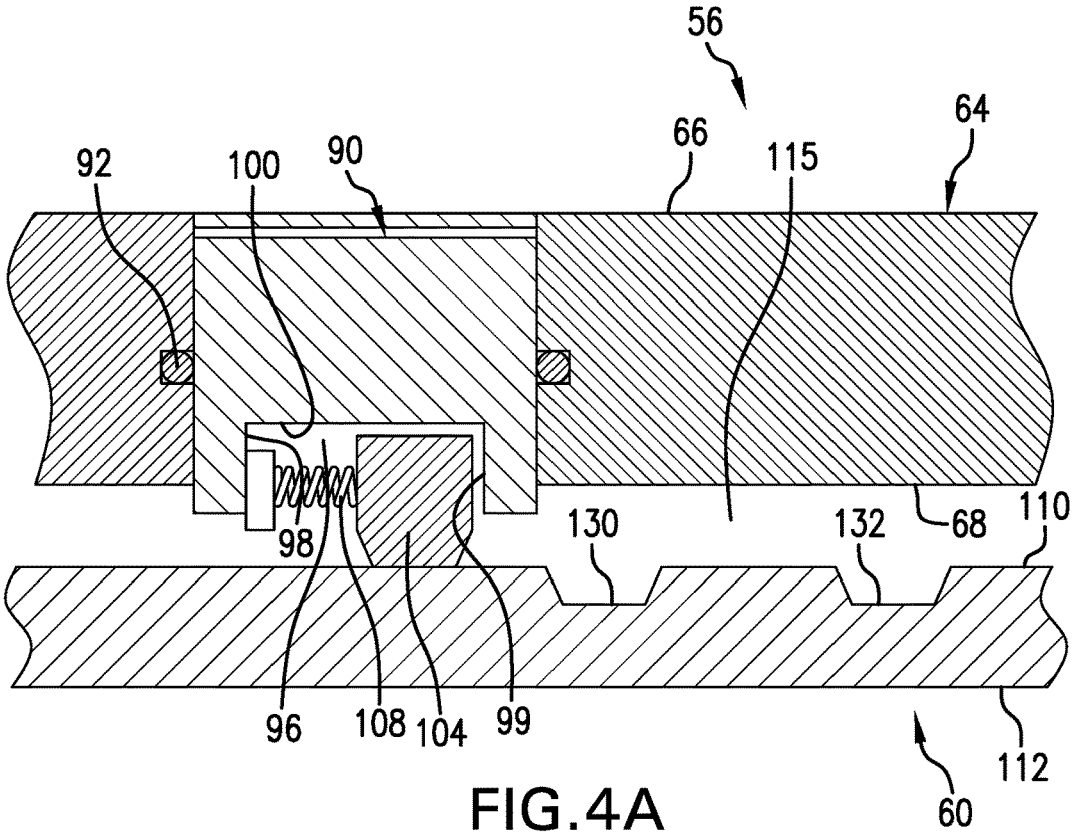
FIG. 4A depicts the escapement system of FIG. 2 in a first position, in accordance with an exemplary aspect.

In an embodiment, a piston 90 is arranged in recess 70. Piston 90 is positioned within a seal 92. Piston 90 includes a recess portion 96 defined by a first radially extending surface 98, a second radially extending surface 99 joined by an axially extending surface 100 as shown in, for example, FIG. 4A. Recessed portion 96 is receptive of an annular locking ring 104 that extends about member 60. Locking ring 104 includes a discontinuity 106 (FIG. 3) and is thus compressible. A spring 108 is provided in recess portion 96 between radially extending surface 98 and locking ring 104. At this point, it should be understood that the number of pistons employed by escapement system 58 may vary as shown in FIG. 3. That is, in FIG. 3, six (6) pistons are arranged about tubular 64 and, as will be detailed herein, act upon locking ring 104.

In an embodiment, member 60 includes a first surface 110 and an opposing second surface 112. First surface 110 is spaced from inner surface 68 of tubular 64 by a first hydraulic chamber 114 and a second hydraulic chamber 115. Member 60 includes a first radially outwardly projecting member 116 and a second radially outwardly projecting member 118. A seal 120 is arranged between first radially outwardly projecting member 116 and second radially outwardly projecting member 118. First hydraulic chamber 114 is defined between second annular seal 77 and seal 120. Second hydraulic chamber 115 is defined between first annular seal 76 and seal 120. First hydraulic chamber 114 is fluidically connected to second branch 86 of hydraulic passage 80 and second hydraulic chamber 115 is fluidically connected to another hydraulic passage 88.

In an embodiment, member 60 includes a plurality of indexing grooves formed in first surface 110. For example, member 60 may includes a first radially inwardly extending groove 130, a second radially inwardly extending groove 132, and a third radially inwardly extending groove 134. The number of indexing grooves may vary. In accordance with an exemplary embodiment, escapement system 58 indexes member 60 axially to selectively cover opening 72. Escapement system 58 may also be employed to uncover opening 72.

Figure 4B:
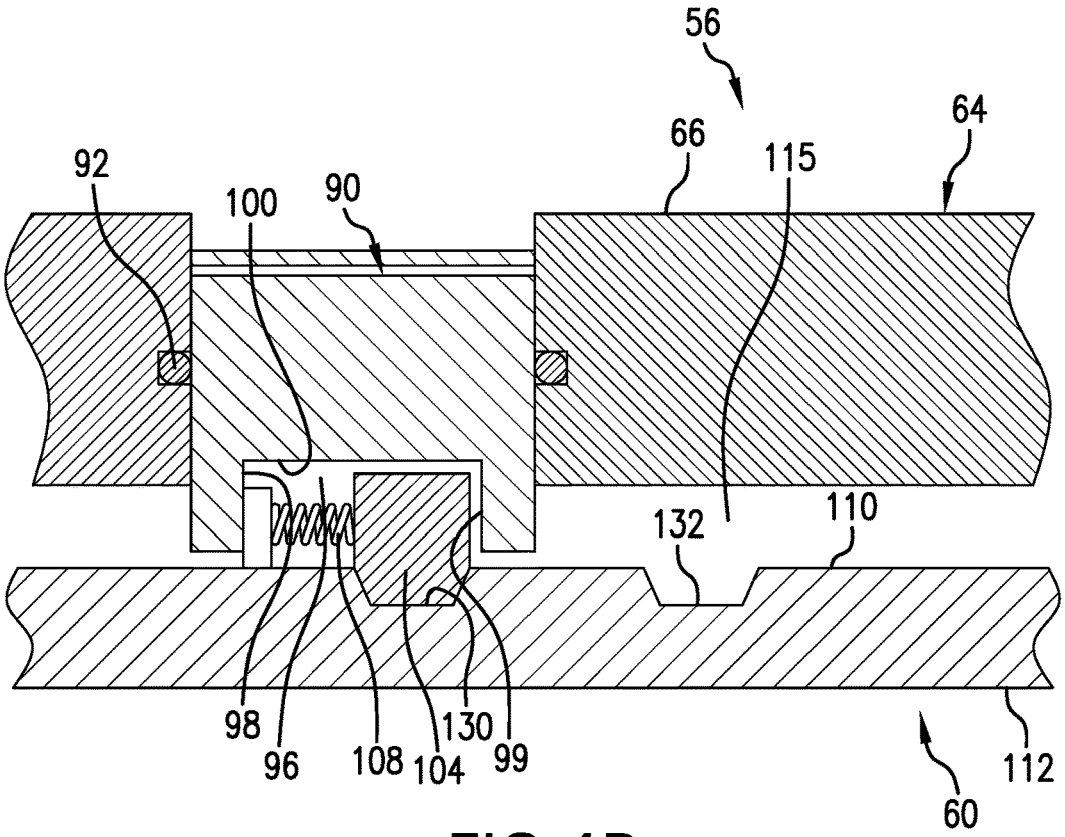
FIG. 4B depicts the escapement system of FIG. 2 in a second position, in accordance with an exemplary aspect.

Reference will now follow to FIGS. 4A-4D in describing a method of operation of escapement system 58. As shown on FIG. 4A, control system 23 may issue a signal to direct fluid to inlet 82 at a first pressure. The fluid flows into first branch 84 and second branch 86 of hydraulic passage 80. The fluid passing into first branch 84 acts on and urges piston 90 radially inwardly relative to tubular 64. That is, piston 90 presses locking ring 104 onto member 60. At the same time, fluid passing int second branch 86 passes into hydraulic chamber 114 and acts upon second radially outwardly projecting member 118 forcing member 60 axially relative to tubular 64. Member 60 moves axially until piston 90 forces locking ring 104 into radially inwardly extending groove 130 as shown in FIG. 4B.

Figure 4C:
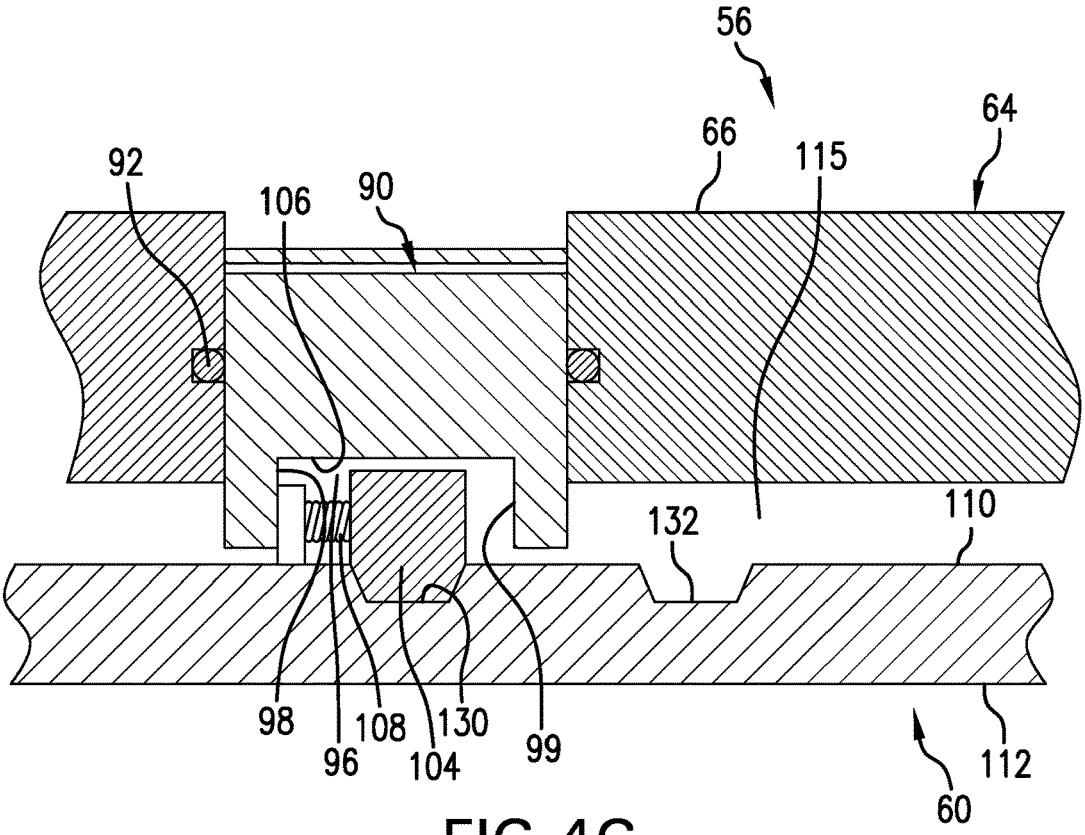
FIG. 4C depicts the escapement system of FIG. 2 in a third position, in accordance with an exemplary aspect.
Figure 4D:
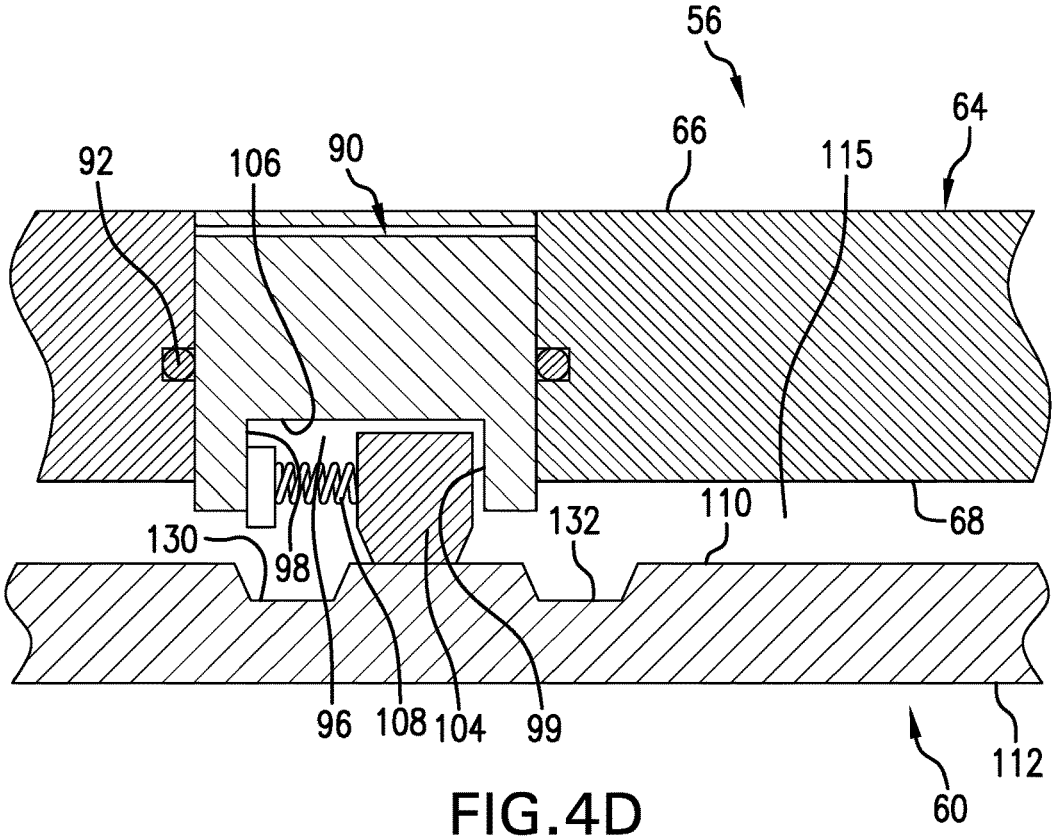
FIG. 4D depicts the escapement system of FIG. 2 in a fourth position, in accordance with an exemplary aspect.

As shown in FIG. 4C, continued application of fluid at the first pressure causes member 60 to force locking ring 104 into spring 108. At this point, member 60 is locked relative to tubular 64 by a radial clamping force applied by piston 90. Control system 23 may then signal to reduce the first pressure causing spring 108 to pop locking ring out of first radially inwardly extending groove 130 and move to the right under the spring force exerted by spring 108 as shown in FIG. 4D. Re-application of the fluid at the first pressure would cause locking ring 104 to move into second radially inwardly extending groove 132 to further shift member 60 axially relative to tubular 64 and further expose opening 72.

Continued application and alleviation of fluid pressure would cause member 60 to index through each radially inwardly extending groove and, eventually fully expose opening 72. At any time, fluid at the first pressure may be removed from inlet 82, and fluid at another pressure which may be the same as, or different than the first pressure is applied to another inlet 89. The fluid flows through another hydraulic passage 88 forcing piston 90 radially outwardly, and member 60 axially relative to tubular 64 to cover opening 72. At this point, it should be understood, that escapement system 58 may be used in a wide range of applications including indexing a member multiple times before, for example, setting a tool. Indexing and rotating a member, or to shift a member for any variety of functions.

Figure 5:
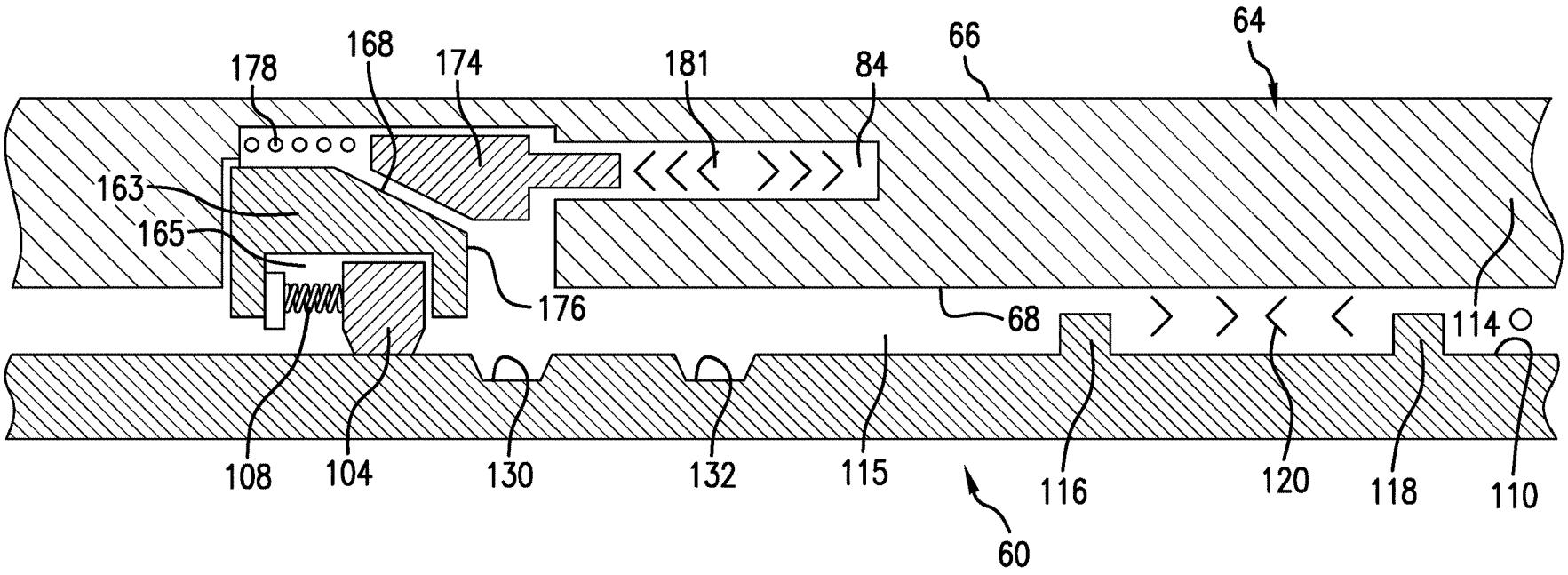
FIG. 5 depicts an escapement system for shifting a member in a downhole tool in accordance with another aspect of an exemplary embodiment.

Reference will now follow to FIG. 5, wherein like reference numbers represent corresponding parts in the respective views, in describing a piston 163 positioned between outer surface 66 and inner surface 68 of tubular 64 in accordance with another aspect of an exemplary embodiment. Piston 163 includes a recess portion 165 that is receptive of locking ring 104 and an angled radial outer surface 168. A piston element 174 is arranged in first branch 84 of hydraulic passage 80. Piston element 174 includes an angled surface section 176 that selectively engages with angled surface of piston 163. Fluid pressure in first branch 84 causes piston element to compress a spring 178 and urge piston 163 radially inwardly.

When pressure is relieved, spring 178 urges piston element 174 into first branch 84 allowing piston 163 to move radially outward. In an embodiment, a slidable seal 181 may be arranged in first branch 84. Slidable seal 181 acts upon piston element 174 to force piston 163 radially inward. The use of slidable seal 181 reduces leak points while the incorporation of piston element 174 may reduces the number of pistons needed for escapement system 58.

Set forth below are some embodiments of the foregoing disclosure:

Embodiment 1. A downhole tool comprising: a tubular including an outer surface, an inner surface, a recess extending from the inner surface toward the outer surface, and an opening extending from the outer surface to the recess; a hydraulic passage extending through the tubular, the hydraulic passage including an inlet, a first branch that extends from the inlet to the recess in a first direction and a second branch that extends from the inlet in a second, opposing direction, the second branch being fluidically exposed at the inner surface; a piston arranged in the recess, the piston being shiftable relative to a radius of the tubular; a locking ring arranged radially inwardly of the piston; and a member arranged in the tubular spaced from the inner surface, wherein application of hydraulic pressure in the first branch urges the piston radially inwardly clamping the locking ring against the member and application of hydraulic pressure in the second branch urges the member axially in a first direction relative to the tubular.

Embodiment 2. The downhole tool according to any prior embodiment, wherein the piston includes a recess portion receptive of the locking ring, the recess portion being defined by at least one radially extending surface and one axially extending surface.

Embodiment 3. The downhole tool according to any prior embodiment, further comprising: a spring arranged between the locking ring and the radially extending surface.

Embodiment 4. The downhole tool according to any prior embodiment, wherein the member includes a radially inwardly extending groove that is selectively receptive of the locking ring.

Embodiment 5. The downhole tool according to any prior embodiment, wherein the radially inwardly extending groove includes a plurality of radially inwardly projecting grooves axially spaced from one another along the member.

Embodiment 6. The downhole tool according to any prior embodiment, further comprising: another opening extending through the outer surface of the tubular, the another opening directing hydraulic pressure between the member and the piston, the hydraulic pressure urging the piston radially outwardly and the member axially in a second direction relative to the tubular.

Embodiment 7. The downhole tool according to any prior embodiment, further comprising: a piston element arranged in the recess between the piston and the first branch, the piston element selectively urging the piston radially inwardly in response to hydraulic pressure in the first branch.

Embodiment 8. A resource exploration and recovery system comprising: a surface system; a sub-surface system including a tubular string extending from the surface system, the tubular string supporting a downhole tool including: a tubular including an outer surface, an inner surface, a recess extending from the inner surface toward the outer surface, and an opening extending from the outer surface to the recess; a hydraulic passage extending through the tubular, the hydraulic passage includes an inlet, a first branch that extends from the inlet in a first direction and a second branch that extends from the inlet in a second, opposing direction, the second branch being fluidically exposed at the inner surface; a piston arranged in the recess, the piston being shiftable along a radius of the tubular; a locking ring arranged radially inwardly of the piston; and a member arranged in the tubular spaced from the inner surface, wherein application of hydraulic pressure in the first branch urges the piston radially inwardly clamping the locking ring against the member and application of hydraulic pressure in the second branch urges the member axially in the reverse direction relative to the tubular.

Embodiment 9. The resource exploration and recovery system according to any prior embodiment, wherein the piston includes a recess portion receptive of the locking ring, the recess portion being defined by at least one radially extending surface and one axially extending surface.

Embodiment 10. The resource exploration and recovery system according to any prior embodiment, further comprising: a spring arranged between the locking ring and the radially extending surface.

Embodiment 11. The resource exploration and recovery system according to any prior embodiment, wherein the member includes a radially inwardly extending groove that is selectively receptive of the locking ring.

Embodiment 12. The resource exploration and recovery system according to any prior embodiment, wherein the radially inwardly extending groove includes a plurality of radially inwardly projecting grooves axially spaced from one another along the member.

Embodiment 13. The resource exploration and recovery system according to any prior embodiment, further comprising: another opening extending through the outer surface of the tubular, the another opening directing hydraulic pressure between the member and the piston, the hydraulic pressure urging the piston radially outwardly and the member axially in a second direction relative to the tubular.

Embodiment 14. The resource exploration and recovery system according to any prior embodiment, further comprising: a piston element arranged in the recess between the piston and the first branch, the piston element selectively urging the piston radially inwardly in response to hydraulic pressure in the first branch.

Embodiment 15. The resource exploration and recovery system according to any prior embodiment, further comprising: an inflow control port extending through the tubular, the member defining a sleeve that selectively exposes a portion of the inflow control port.

Embodiment 16. A method of shifting a member in a downhole tool comprising: introducing fluid at a first pressure into an opening in a tubular; directing the fluid at the first pressure in a first direction to shift a member axially relative to the tubular; and directing the fluid at the first pressure in a second direction opposite the first direction, urging a piston radially inwardly onto the member.

Embodiment 17. The method according to any prior embodiment, wherein urging the piston radially inwardly includes driving a locking ring into a groove formed on the member.

Embodiment 18. The method according to any prior embodiment, further comprising: reducing the fluid to a second pressure; and biasing the locking ring from the groove with a spring.

Embodiment 19. The method according to any prior embodiment, re-introducing fluid at the first pressure to further shift the member axially and urge the piston radially inwardly driving the locking ring into another groove.

Embodiment 20. The method according to any prior embodiment, wherein urging the piston radially inwardly includes forcing a piston element axially relative to the tubular into contact with the piston.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another.

The terms "about" and "substantially" are intended to include the degree of error associated with measurement of the particular quantity based upon the equipment available at the time of filing the application. For example, "about" and/or "substantially" can include a range of ±8% or 5%, or 2% of a given value.

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A downhole tool comprising:

a tubular including an outer surface, an inner surface, a recess extending from the inner surface toward the outer surface, and an opening extending from the outer surface to the recess;

a hydraulic passage extending through the tubular, the hydraulic passage including an inlet, a first branch that extends from the inlet to the recess in a first direction and a second branch that extends from the inlet in a second, opposing direction, the second branch being fluidically exposed at the inner surface;

a piston arranged in the recess, the piston being shiftable relative to a radius of the tubular;

a locking ring arranged radially inwardly of the piston; and a member arranged in the tubular spaced from the inner surface, wherein application of hydraulic pressure in the first branch urges the piston radially inwardly clamping the locking ring against the member and application of hydraulic pressure in the second branch urges the member axially in a first direction relative to the tubular.

2. The downhole tool according to claim 1, wherein the piston includes a recess portion receptive of the locking ring, the recess portion being defined by at least one radially extending surface and one axially extending surface.

3. The downhole tool according to claim 2, further comprising: a spring arranged between the locking ring and the radially extending surface.

4. The downhole tool according to claim 1, wherein the member includes a radially inwardly extending groove that is selectively receptive of the locking ring.

5. The downhole tool according to claim 4, wherein the radially inwardly extending groove includes a plurality of radially inwardly projecting grooves axially spaced from one another along the member.

6. The downhole tool according to claim 1, further comprising: another opening extending through the outer surface of the tubular, the another opening directing hydraulic pressure between the member and the piston, the hydraulic pressure urging the piston radially outwardly and the member axially in a second direction relative to the tubular.

7. The downhole tool according to claim 1, further comprising: a piston element arranged in the recess between the piston and the first branch, the piston element selectively urging the piston radially inwardly in response to hydraulic pressure in the first branch.

8. A resource exploration and recovery system comprising:

a surface system;

a sub-surface system including a tubular string extending from the surface system, the tubular string supporting a downhole tool including:

a tubular including an outer surface, an inner surface, a recess extending from the inner surface toward the outer surface, and an opening extending from the outer surface to the recess;

a hydraulic passage extending through the tubular, the hydraulic passage includes an inlet, a first branch that extends from the inlet in a first direction and a second branch that extends from the inlet in a second, opposing direction, the second branch being fluidically exposed at the inner surface;

a piston arranged in the recess, the piston being shiftable along a radius of the tubular;

a locking ring arranged radially inwardly of the piston; and a member arranged in the tubular spaced from the inner surface, wherein application of hydraulic pressure in the first branch urges the piston radially inwardly clamping the locking ring against the member and application of hydraulic pressure in the second branch urges the member axially in the reverse direction relative to the tubular.

9. The resource exploration and recovery system according to claim 8, wherein the piston includes a recess portion receptive of the locking ring, the recess portion being defined by at least one radially extending surface and one axially extending surface.

10. The resource exploration and recovery system according to claim 9, further comprising: a spring arranged between the locking ring and the radially extending surface.

11. The resource exploration and recovery system according to claim 8, wherein the member includes a radially inwardly extending groove that is selectively receptive of the locking ring.

12. The resource exploration and recovery system according to claim 11, wherein the radially inwardly extending groove includes a plurality of radially inwardly projecting grooves axially spaced from one another along the member.

13. The resource exploration and recovery system according to claim 8, further comprising: another opening extending through the outer surface of the tubular, the another opening directing hydraulic pressure between the member and the piston, the hydraulic pressure urging the piston radially outwardly and the member axially in a second direction relative to the tubular.

14. The resource exploration and recovery system according to claim 8, further comprising: a piston element arranged in the recess between the piston and the first branch, the piston element selectively urging the piston radially inwardly in response to hydraulic pressure in the first branch.

15. The resource exploration and recovery system according to claim 8, further comprising: an inflow control port extending through the tubular, the member defining a sleeve that selectively exposes a portion of the inflow control port.

16. A method of shifting a member in a downhole tool comprising:

introducing fluid at a first pressure into an opening in a tubular;

directing the fluid at the first pressure in a first direction to shift a member axially relative to the tubular; and directing the fluid at the first pressure in a second direction opposite the first direction, urging a piston radially inwardly onto the member.

17. The method of claim 16, wherein urging the piston radially inwardly includes driving a locking ring into a groove formed on the member.

18. The method of claim 17, further comprising:

reducing the fluid to a second pressure; and biasing the locking ring from the groove with a spring.

19. The method of claim 18, re-introducing fluid at the first pressure to further shift the member axially and urge the piston radially inwardly driving the locking ring into another groove.

20. The method of claim 16, wherein urging the piston radially inwardly includes forcing a piston element axially relative to the tubular into contact with the piston.

* * * * *